US010629371B2

(12) United States Patent
Itoh et al.

(10) Patent No.: US 10,629,371 B2
(45) Date of Patent: Apr. 21, 2020

(54) METHOD OF MANUFACTURING COIL COMPONENT

(71) Applicant: FUJITSU LIMITED, Kawasaki-shi, Kanagawa (JP)

(72) Inventors: Masayuki Itoh, Kawasaki (JP); Hiroshi Kurosawa, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 463 days.

(21) Appl. No.: 15/618,745

(22) Filed: Jun. 9, 2017

(65) Prior Publication Data

US 2017/0278629 A1 Sep. 28, 2017

Related U.S. Application Data

(62) Division of application No. 14/717,455, filed on May 20, 2015, now Pat. No. 9,812,257.

(30) Foreign Application Priority Data

Jun. 26, 2014 (JP) ..... 2014-131322

(51) Int. Cl.

| | |
|---|---|
| ***H01F 7/06*** | (2006.01) |
| ***H01F 41/04*** | (2006.01) |
| ***H01F 17/00*** | (2006.01) |
| *H01F 27/29* | (2006.01) |

(52) U.S. Cl.

CPC ..... *H01F 41/041* (2013.01); *H01F 17/0013* (2013.01); *H01F 27/292* (2013.01)

(58) Field of Classification Search

CPC .... H01F 17/00; H01F 27/245; H01F 27/2823; H01F 27/292; H01F 41/02; H01F 41/041; H05K 1/165; H05K 3/4682

See application file for complete search history.

(56) References Cited

U.S. PATENT DOCUMENTS

| | | | | |
|---|---|---|---|---|
| 6,178,623 | B1 * | 1/2001 | Kitazawa | C25D 5/10 29/825 |
| 9,466,422 | B2 * | 10/2016 | Motomiya | H01F 17/0013 |
| 9,786,424 | B2 * | 10/2017 | Park | H01F 17/0033 |
| 9,814,167 | B2 * | 11/2017 | Park | H05K 9/0067 |
| 9,972,436 | B2 * | 5/2018 | Hamada | H01F 41/04 |

(Continued)

FOREIGN PATENT DOCUMENTS

| | | |
|---|---|---|
| JP | 8-222695 | 8/1996 |
| JP | 10-125533 | 5/1998 |

(Continued)

OTHER PUBLICATIONS

Japanese Office Action dated Apr. 3, 2018 in Japanese Patent Application No. 2014-131322.

(Continued)

*Primary Examiner* — Paul D Kim

(74) *Attorney, Agent, or Firm* — Staas & Halsey LLP

(57) ABSTRACT

A method of manufacturing a coil component, includes forming a conductive pattern on a substrate; forming an opening portion over a surface of the substrate so as to be disposed between neighboring conductors of the conductive pattern, the opening portion having a depth that is equivalent to or greater than a clearance dimension between the neighboring conductors; and forming a coil pattern by growing the conductive pattern including by plating.

9 Claims, 17 Drawing Sheets

(56) References Cited

U.S. PATENT DOCUMENTS

| | | | | |
|---|---|---|---|---|
| 10,039,190 | B2 * | 7/2018 | Yoshioka | G07D 7/164 |
| 2003/0052765 | A1 | 3/2003 | Kanetaka | |
| 2006/0017539 | A1 | 1/2006 | Lee et al. | |
| 2013/0293337 | A1 | 11/2013 | Lo | |

FOREIGN PATENT DOCUMENTS

| | | |
|---|---|---|
| JP | 10-261531 | 9/1998 |
| JP | 2002-134323 | 5/2002 |
| JP | 2006-032976 | 2/2006 |
| JP | 2008-103482 | 5/2008 |

OTHER PUBLICATIONS

Notice of Allowance issued in co-pending U.S. Appl. No. 14/717,455 dated Apr. 21, 2017.
Final Office Action issued in co-pending U.S. Appl. No. 14/717,455 dated Jan. 27, 2017.
Office Action issued in co-pending U.S. Appl. No. 14/717,455 dated Jul. 15, 2016.
Restriction Requirement issued in co-pending U.S. Appl. No. 14/717,455 dated Apr. 21, 2016.
U.S. Appl. No. 14/717,455, filed May 20, 2015, Masayuki Itoh, Fujitsu Limited.

* cited by examiner

METHOD OF MANUFACTURING COIL COMPONENT

CROSS-REFERENCE TO RELATED APPLICATION

This application is a divisional application of U.S. Ser. No. 14/717,455 filed on May 20, 2015, now U.S. Pat. No. 9,812,257, which claims the benefit of priority of the prior Japanese Patent Application No. 2014-131322, filed on Jun. 26, 2014, the entire contents of which are incorporated herein by reference.

FIELD

The embodiment discussed herein is related to, for example, a coil component and a method for manufacturing the coil component.

BACKGROUND

In recent years, further reduction in size of coil components (inductors) employed in mobile devices, such as mobile phones, smartphones, tablet PCs are called for due to multi-functionalization of the devices.

A thin-film coil component is known as a structure designed to reduce the size of the coil component. In the thin-film coil component, a coil pattern is formed on a substrate by growing a conductive pattern, which is formed on the substrate with a conductor such as copper, by plating. In such a structure, an increase in the cross-sectional area of the coil pattern by plating leads to a reduction in resistance. As a result, the current capacity of the coil is increased and the device may be devised to have high efficiency. Related techniques are disclosed in Japanese Laid-open Patent Publication No. 10-125533, Japanese Laid-open Patent Publication No. 2006-32976, Japanese Laid-open Patent Publication No. 10-261531, and Japanese Laid-open Patent Publication No. 2008-103482, for example.

SUMMARY

In accordance with an aspect of the embodiments, a method of manufacturing a coil component, includes forming a conductive pattern on a substrate; forming an opening portion over a surface of the substrate so as to be disposed between neighboring conductors of the conductive pattern, the opening portion having a depth that is equivalent to or greater than a clearance dimension between the neighboring conductors; and forming a coil pattern by growing the conductive pattern including by plating.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which.

DESCRIPTION OF EMBODIMENT

Hereinafter, an embodiment related to the present application will be described with reference to the drawings.

Embodiment

Figure 1:
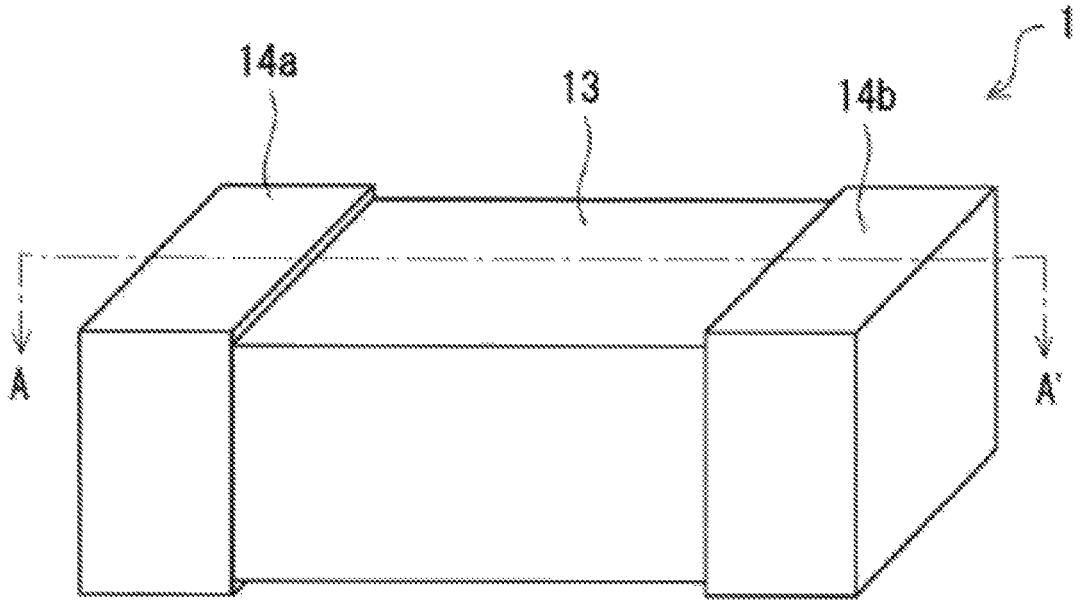
FIG. 1 is an external perspective view of a coil component according to an embodiment.
Figure 2:
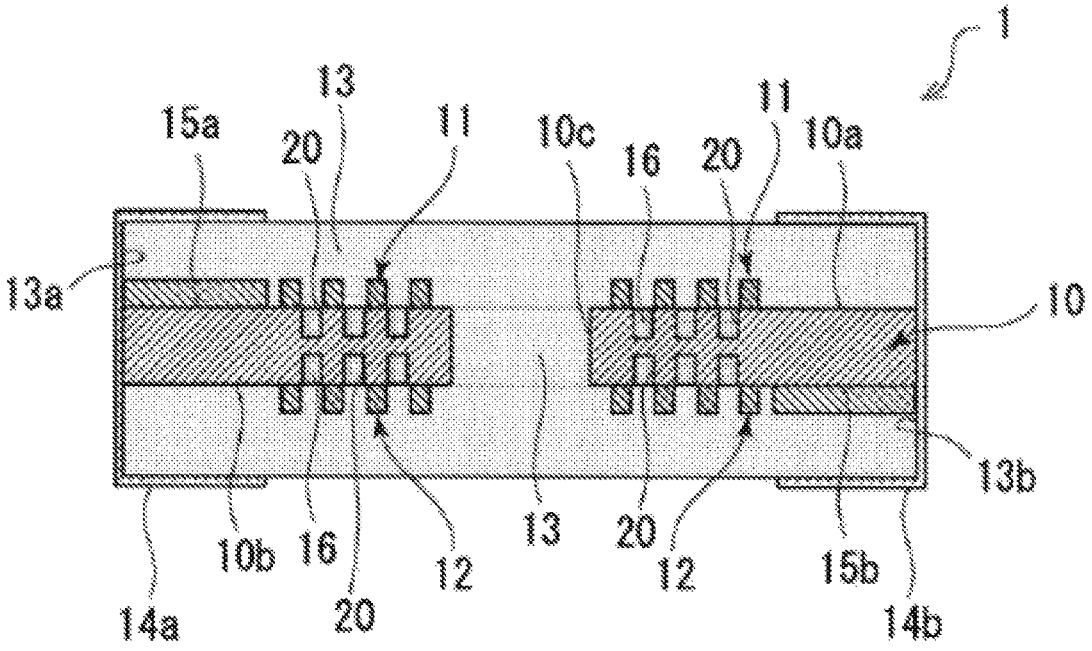
FIG. 2 is a cross-sectional arrow view along line A-A' of FIG. 1.

FIG. 1 is an external perspective view of a coil component 1 according to an embodiment. The coil component 1 is a chip component that is also referred to as an "inductor". FIG. 2 is a cross-sectional arrow view along line A-A' of FIG. 1. The coil component 1 includes an insulating substrate 10, a conductive first coil pattern 11 formed on an upper surface 10*a* of the insulating substrate 10, a conductive second coil pattern 12 formed on an undersurface 10*b* of the insulating substrate 10, an exterior core 13, a pair of external electrodes 14*a* and 14*b*, and the like.

Figure 3:
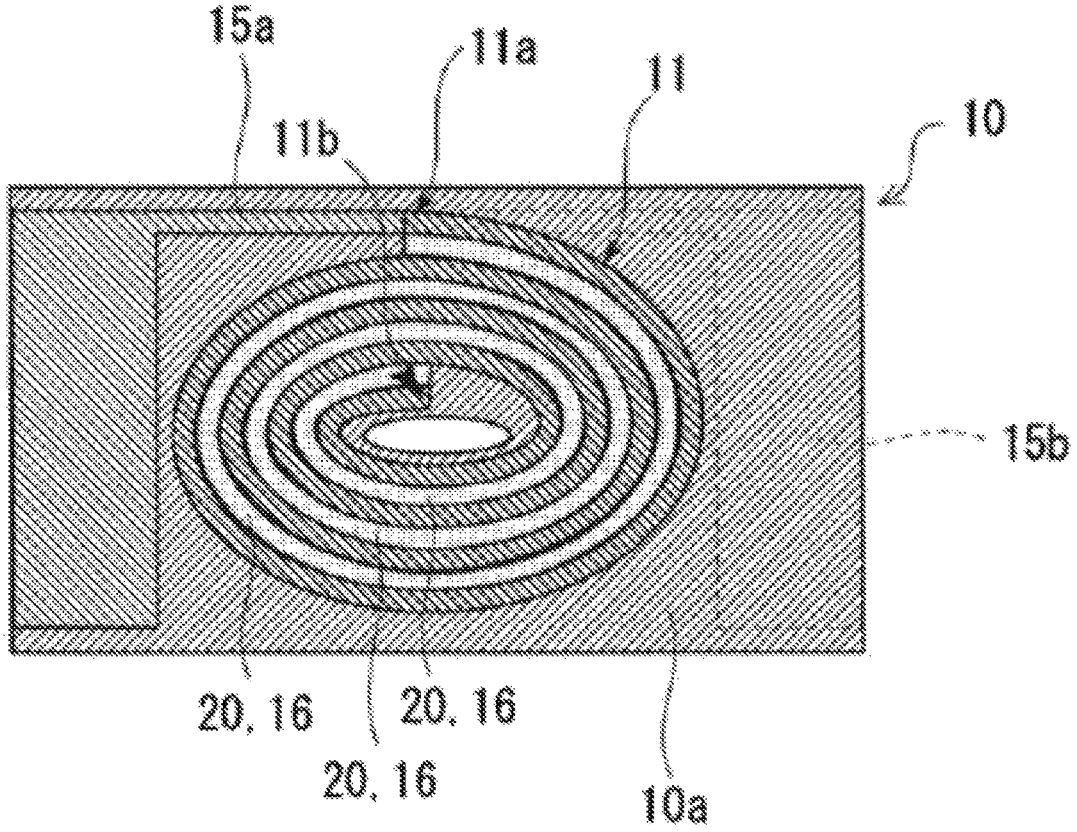
FIG. 3 is a top view of an insulating substrate according to the embodiment.
Figure 4:
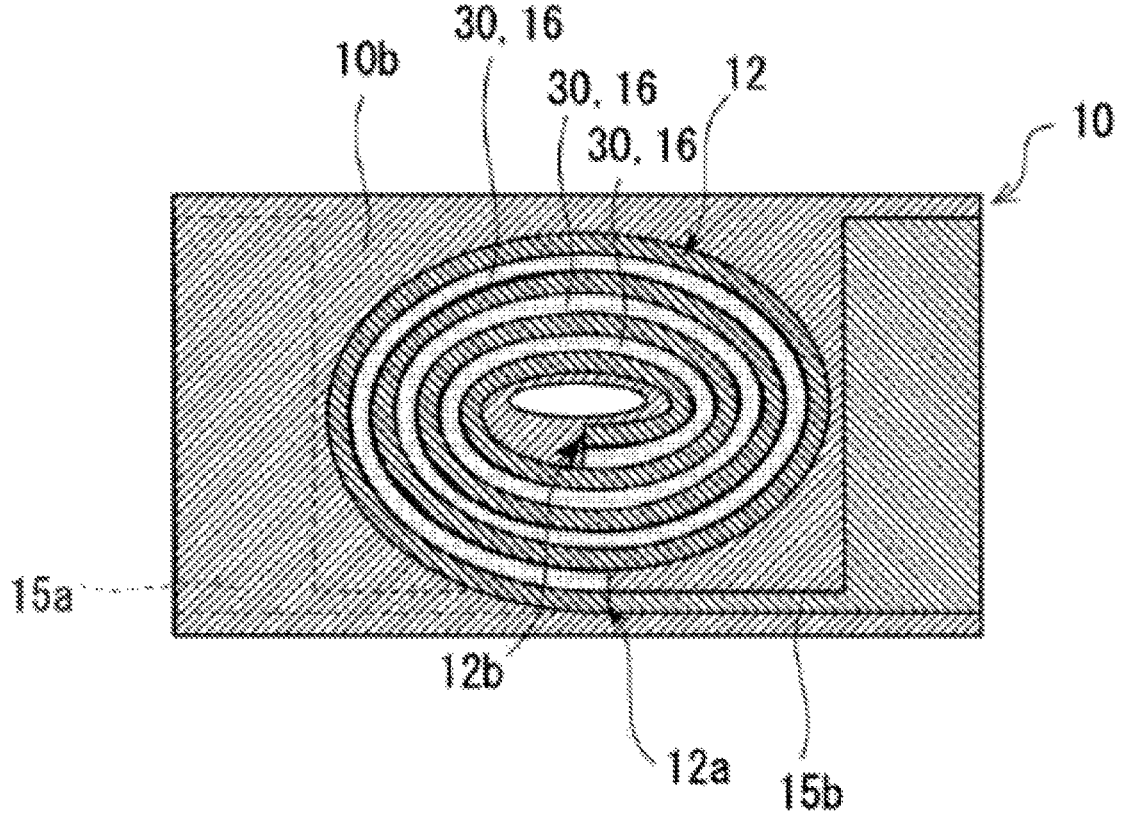
FIG. 4 is a bottom view of the insulating substrate according to the embodiment.

The insulating substrate 10 is an insulating resin substrate, for example. FIG. 3 is a top view of the insulating substrate 10 viewed from the upper surface 10*a* side. FIG. 4 is a bottom view of the insulating substrate 10 viewed from the undersurface 10*b* side. As illustrated in FIG. 3, the insulating substrate 10 has a substantially rectangular flat surface, and a substantially oval opening 10*c* is formed in a middle portion thereof. The opening 10*c* penetrates the insulating substrate 10 in a thickness direction.

The insulating substrate 10 is a base material for forming the first coil pattern 11 and the second coil pattern 12. As illustrated in FIGS. 3 and 4, in plan view, the first coil pattern 11 and the second coil pattern 12 have a spiral (a volute or a loop) shape. In the illustrated examples, although in the first coil pattern 11 and the second coil pattern 12, the number of laps is four, the number of laps is not limited to a specific number. Each of the first coil pattern 11 and the second coil pattern 12 is formed by growing a conductor, which has been formed in a spiral pattern, by plating; accordingly, a sufficient thickness of each of the conductors is obtained. With the above, lowering of the coil resistance is achieved and the current capacity of the coil is increased; accordingly, the device is devised so as to be highly efficient.

Although the first coil pattern 11 and the second coil pattern 12 of the present embodiment are, as illustrated in FIGS. 3 and 4, formed into oval spirals, the first coil pattern 11 and the second coil pattern 12 may be, for example, circular or rectangular spirals, or may have a different shape. The first coil pattern 11 and the second coil pattern 12 are arranged so as to surround the opening 10*c* of the insulating substrate 10. The first coil pattern 11 and the second coil pattern 12 overlap each other in plan view.

The first coil pattern 11 viewed from the upper surface 10*a* side of the insulating substrate 10 forms a spiral that runs clockwise from an outer peripheral end 11*a* to an inner peripheral end 11*b*. Meanwhile, the second coil pattern 12 viewed from the undersurface 10*b* side of the insulating substrate 10 forms a spiral that runs clockwise from an outer peripheral end 12*a* to an inner peripheral end 12*b*. Furthermore, the inner peripheral end 11*b* of the first coil pattern 11 and the inner peripheral end 12*b* of the second coil pattern 12 are electrically coupled to each other through a through hole conductor (not shown) that penetrates the insulating substrate 10.

The insulating substrate 10 including the first coil pattern 11 and the second coil pattern 12 is covered by the exterior core 13. The exterior core 13 is a resin containing a magnetic substance, for example. The resin containing a magnetic substance is a magnetic material formed by mixing magnetic metal powder and resin together. Furthermore, the resin contained in the resin containing a magnetic substance functions as an insulating binding agent, for example. Liquid epoxy resin, powder epoxy resin, or the like may be used as the material for the resin. In the example illustrated in FIG. 1, although the exterior core 13 has a substantially rectangular parallelepiped shape, the exterior core 13 may have a different shape. Note that the surface of the exterior core 13 may be coated by an insulating coating (not shown).

As illustrated in FIG. 1, a pair of external electrodes 14*a* and 14*b* are formed at the two end portions of the coil component 1 (the exterior core 13). The outer peripheral end 11*a* of the first coil pattern 11 is extended to a lateral side 13*a* on one side of the exterior core 13 with a first extraction electrode 15*a* and is coupled to the external electrode 14*a* on one side through the first extraction electrode 15*a*. Furthermore, the outer peripheral end 12*a* of the second coil pattern 12 is extended to a lateral side 13*b* on the other side of the exterior core 13 with a second extraction electrode 15*b* and is coupled to the external electrode 14*b* on the other side through the second extraction electrode 15*b*.

Figure 5:
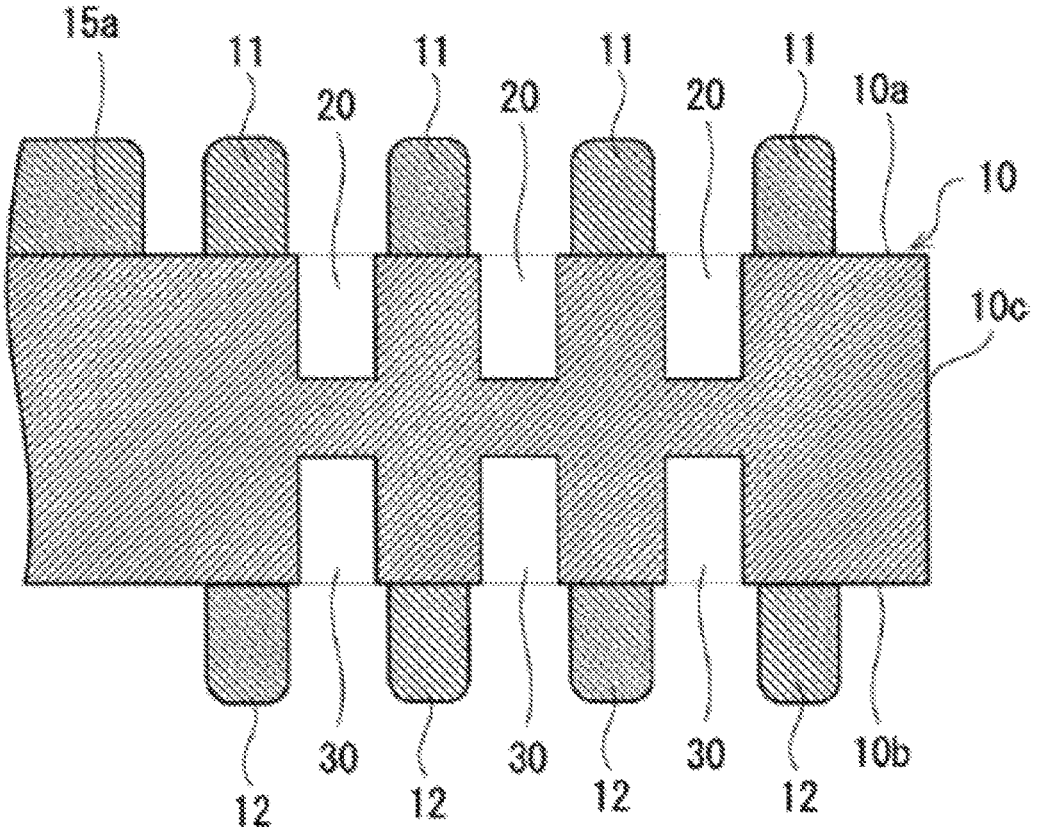
FIG. 5 is a diagram for describing a detailed structure of the insulating substrate of the coil component according to the embodiment.

A detailed structure of the insulating substrate 10 will be described next. FIG. 5 is a diagram for describing the detailed structure of the insulating substrate 10 of the coil component 1 according to the embodiment. FIG. 5 schematically illustrates a partial cross-sectional view of the first coil pattern 11 and the second coil pattern 12 formed on the insulating substrate 10. In FIG. 5, illustration of the exterior core 13 is omitted. As illustrated in FIG. 5, a first recessed groove 20 and a second recessed groove 30 are provided in the upper surface 10*a* and the undersurface 10*b*, respectively, of the insulating substrate 10. The first recessed groove 20 is provided on the upper surface 10*a* side of the insulating substrate 10, and the second recessed groove 30 is provided on the undersurface 10*b* side of the insulating substrate 10.

As illustrated in FIG. 3, the first recessed groove 20 open in the upper surface 10*a* of the insulating substrate 10 is disposed between the neighboring conductors of the first coil pattern 11, in other words, the first recessed groove 20 is disposed between the turns going around in a spiral manner. In plan view, the first recessed groove 20 has the same spiral shape as the first coil pattern 11 such that the spiral of the first recessed groove 20 goes around along the spiral of the first coil pattern 11. Meanwhile, as illustrated in FIG. 4, the second recessed groove 30 open in the undersurface 10*b* of the insulating substrate 10 is disposed between the neighboring conductors of the second coil pattern 12, in other words, the second recessed groove 30 is disposed between the turns going around in a spiral manner. In plan view, the second recessed groove 30 has the same or analogous spiral shape as the second coil pattern 12 such that the spiral of the second recessed groove 30 goes around along the spiral of the second coil pattern 12.

Note that a clearance dimension (a separation dimension) between the neighboring conductors of the first coil pattern 11 is referred to as a "first coil conductor interval W1". Furthermore, a clearance dimension between the neighboring conductors of the second coil pattern 12 is referred to as a "second coil conductor interval W2". Furthermore, depth dimensions of the first recessed groove 20 and the second recessed groove 30 are referred to as a "first recessed groove depth D1" and a "second recessed groove depth D2", respectively. In the present embodiment, the first coil conductor interval W1 of the first coil pattern 11 is uniform across the outer peripheral end 11*a* and the inner peripheral end 11*b*. Furthermore, the second coil conductor interval W2 of the second coil pattern 12 is uniform across the outer peripheral end 12*a* and the inner peripheral end 12*b*. Furthermore, the first recessed groove depth D1 and the second recessed groove depth D2 are uniform in the extending directions of the spirals of the first recessed groove 20 and the second recessed groove 30, respectively. Moreover, the first recessed groove depth D1 of the first recessed groove 20 is configured so that the dimension thereof is equivalent to or greater than that of the first coil conductor interval W1 of the first coil pattern 11. Furthermore, the second recessed groove depth D2 of the second recessed groove 30 is configured so that the dimension thereof is equivalent to or greater than that of the second coil conductor interval W2 of the second coil pattern 12. In the present embodiment, the first recessed groove depth D1 and the second recessed groove depth D2 are mutually the same; however, the configuration is not limited to the above. The first recessed groove 20 and the second recessed groove 30 are each an example of an opening portion that is formed as a recessed groove and that is open in the surface of the substrate.

Figure 6:
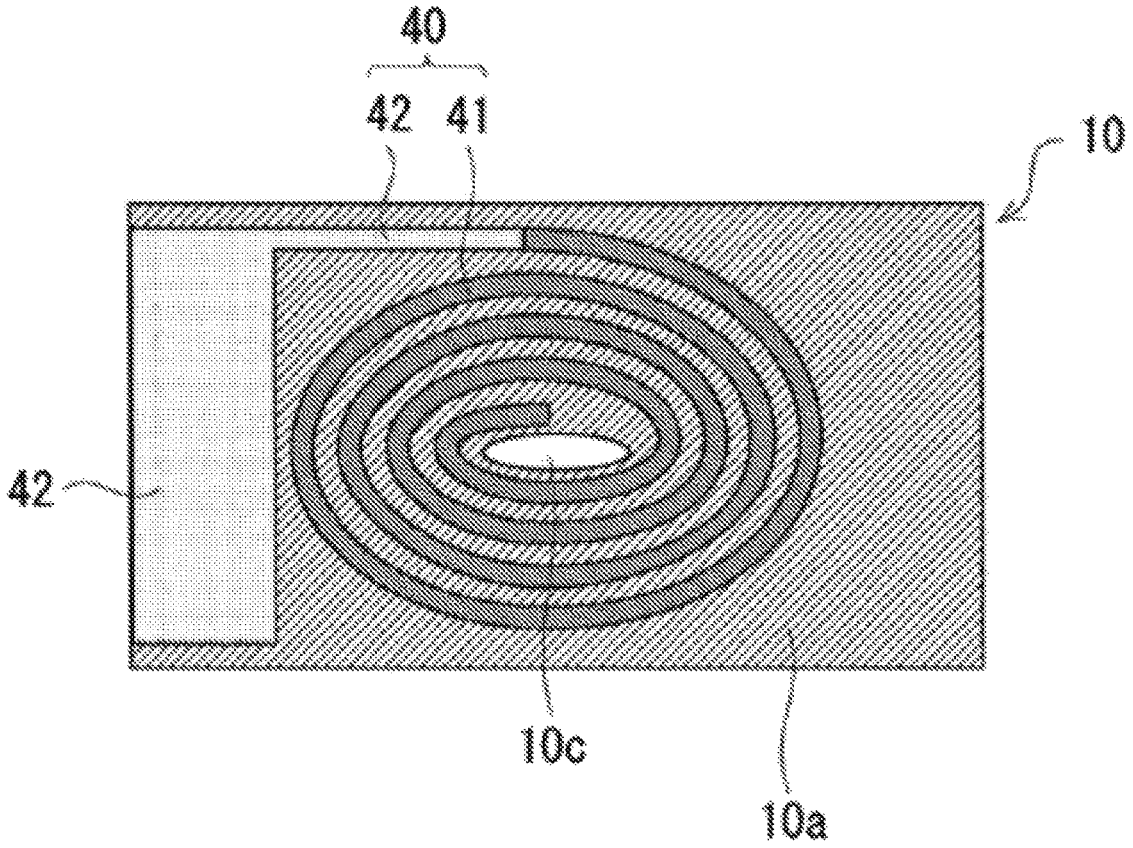
FIG. 6 is a process drawing for describing a manufacturing process of the coil component according to the embodiment.
Figure 7:
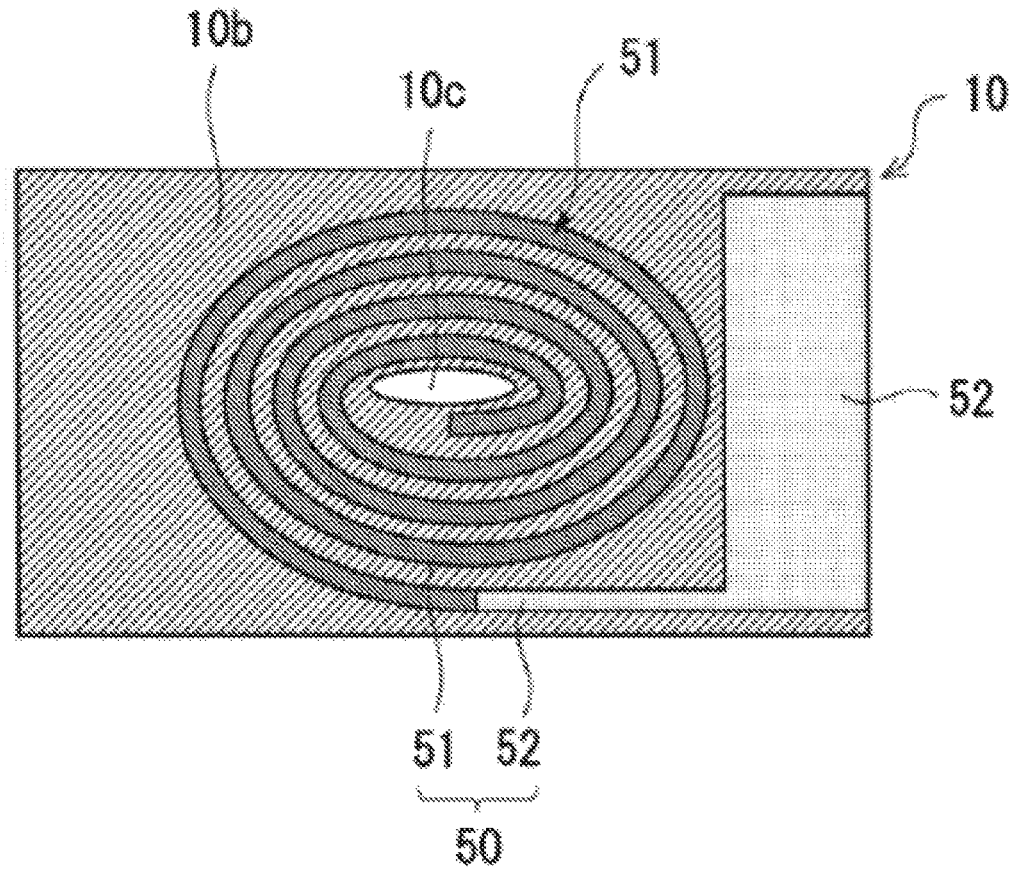
FIG. 7 is a process drawing for describing the manufacturing process of the coil component according to the embodiment.

FIGS. 6 and 7 are process drawings for describing a manufacturing process of the coil component 1 according to the embodiment. As illustrated in FIGS. 6 and 7, the insulating substrate 10 in which the opening 10*c* and the through hole (not shown) are formed at predetermined positions is prepared first. Then, pattern formation of a first conductive pattern 40 is performed on the upper surface 10*a* of the insulating substrate 10 (see FIG. 6) and pattern formation of a second conductive pattern 50 is performed on the undersurface 10*b* of the insulating substrate 10 (see FIG. 7). In FIG. 6, the upper surface 10*a* of the insulating substrate 10 on which the first conductive pattern 40 is formed is illustrated and, in FIG. 7, the undersurface 10*b* of the insulating substrate 10 on which the second conductive pattern 50 is formed is illustrated. The first conductive pattern 40 includes a first spiral conductor 41 and a conductor 42 for the first extraction electrode. Furthermore, the second conductive pattern 50 includes a second spiral conductor 51 and a conductor 52 for the second extraction electrode.

As illustrated in FIG. 6, the first spiral conductor 41 has an oval-spiral shape and is grown by plating into the first coil pattern 11 illustrated in FIG. 3. Furthermore, the conductor 42 for the first extraction electrode is grown by plating into the first extraction electrode 15*a* illustrated in FIG. 3. Furthermore, as illustrated in FIG. 7, the second spiral conductor 51 has an oval-spiral shape and is grown by plating into the second coil pattern 12 illustrated in FIG. 4. Furthermore, the conductor 52 for the second extraction electrode is grown by plating into the second extraction electrode 15*b* illustrated in FIG. 4. The first spiral conductor 41 and the second spiral conductor 51 have the same spiral shape in plan view and the spiral shapes overlap one another in the up-down direction.

In the present embodiment, the first conductive pattern 40 and the second conductive pattern 50 is formed of copper (Cu). For example, a copper base film is formed on substantially the entire surface of the insulating substrate 10 by electroless plating. In such a case, a copper film is formed inside the through hole (not shown) of the insulating substrate 10. Note that the through hole is provided at a position corresponding to the positions of the inner peripheral ends of the first spiral conductor 41 and the second spiral conductor 51, and the first spiral conductor 41 and the second spiral conductor 51 are electrically connected to each other by the through hole. Then after, for example, by exposing and developing a photoresist, pattern formation of the first conductive pattern 40 and the second conductive pattern 50 may be performed.

Figure 8:
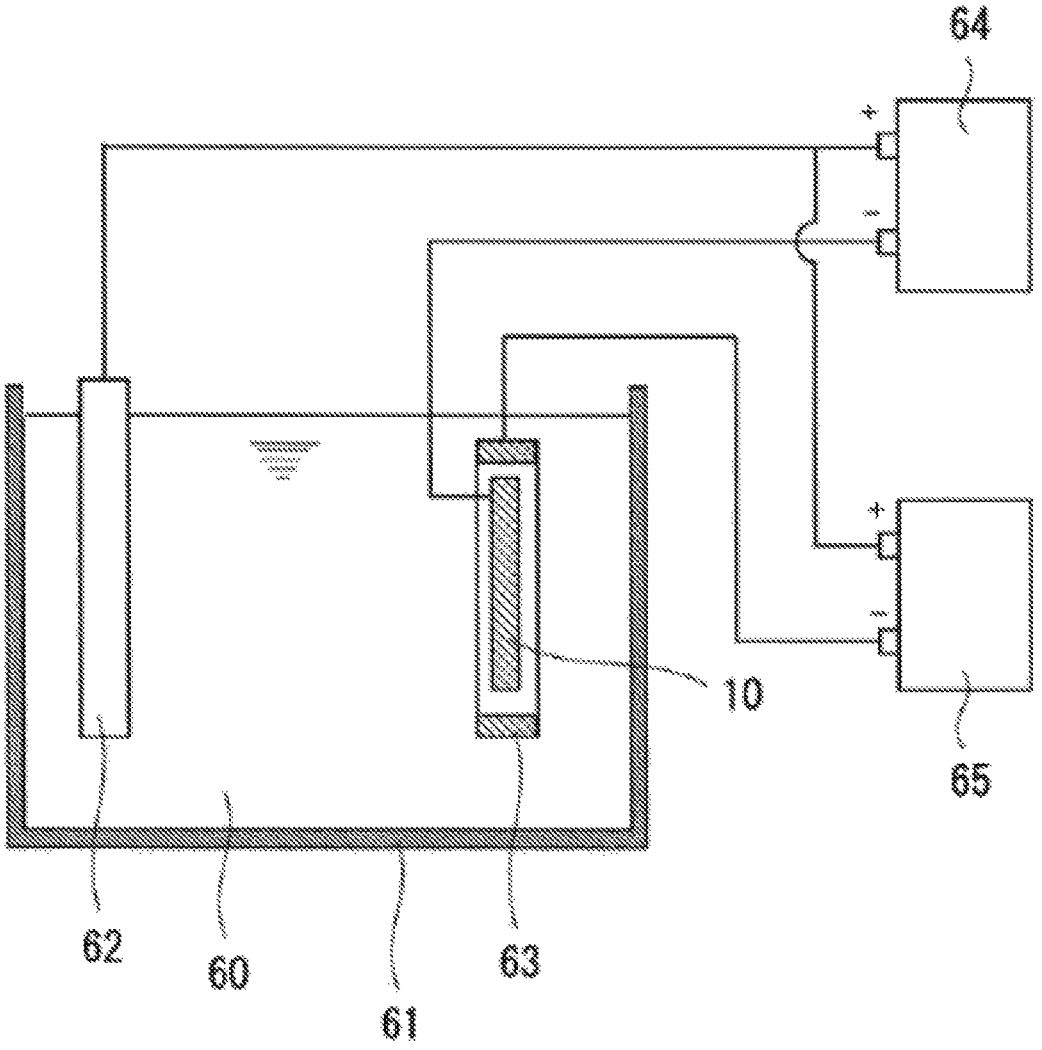
FIG. 8 is a process drawing illustrating a process of performing electroplating on the insulating substrate according to the embodiment.

Next, electroplating is performed, and the first conductive pattern 40 and the second conductive pattern 50 are grown by plating. Specifically, a plating bath 61 such as the one illustrated in FIG. 8 is prepared and electroplating is performed while the insulating substrate 10, the first conductive pattern 40 and the second conductive pattern 50 being formed on the surfaces thereof, is dipped in a plating solution 60 that is retained in the plating bath 61. As a result, the first spiral conductor 41 of the first conductive pattern 40 and the conductor 42 for the first extraction electrode are grown by plating; accordingly, the first coil pattern 11 and the first extraction electrode 15*a*, respectively, are formed on the upper surface 10*a* of the insulating substrate 10 (see FIG. 3). Furthermore, the second spiral conductor 51 of the second conductive pattern 50 and the conductor 52 for the second extraction electrode are grown by plating; accordingly, the second coil pattern 12 and the second extraction electrode 15*b*, respectively, are formed on the undersurface 10*b* of the insulating substrate 10 (see FIG. 4). Note that regarding the reference numerals illustrated in FIG. 8, 62 is an anode, 63 is an auxiliary electrode, 64 is a power source for the substrate, and 65 is a power source for the auxiliary electrode.

Next, the first recessed groove 20 and the second recessed groove 30 that are described in FIGS. 3 to 5 are formed on the upper surface 10*a* and the undersurface 10*b*, respectively, of the insulating substrate 10. The first recessed groove 20 and the second recessed groove 30 may be formed by laser beam machining, for example. Next, after insulating resin 16 such as epoxy resin is filled into the first recessed groove 20 and the second recessed groove 30 in the insulating substrate 10, the insulating substrate 10 is covered by the exterior core 13 including resin containing a magnetic substance. For example, the exterior core 13 may be formed by, after printing a paste including resin containing a magnetic substance onto the insulating substrate 10 with a printer (not shown), curing the paste through heating. Then after, the external electrodes 14*a* and 14*b* may be formed on the two end portions of the exterior core 13; accordingly, the coil component 1 described in FIGS. 1 to 5 is completed. Note that in the coil component 1, filling of the resin 16 into the first recessed groove 20 and the second recessed groove 30 may be omitted as appropriate.

Figure 9:
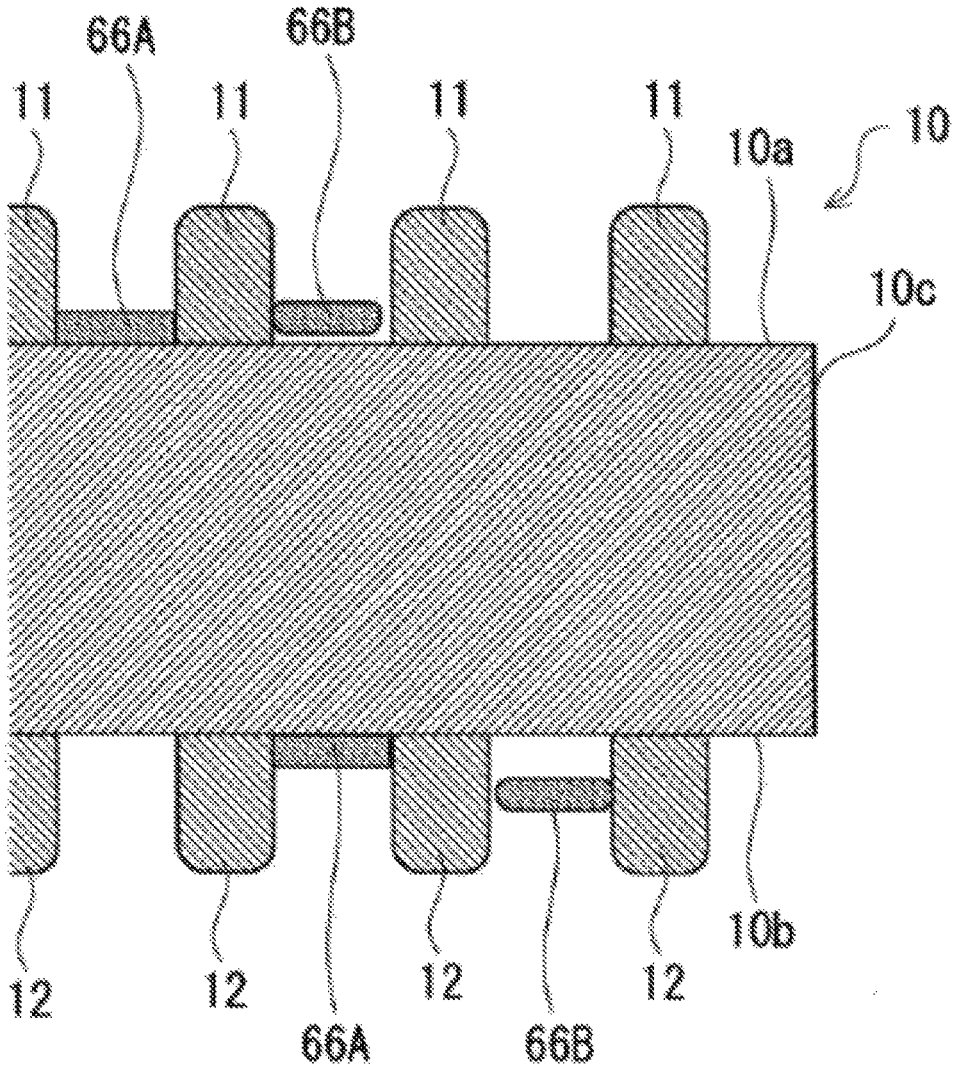
FIG. 9 is a diagram for describing a state in which plating residues adhere to portions between conductors of a coil pattern.

Functions of the first recessed groove 20 and the second recessed groove 30 formed in the insulating substrate 10 in the coil component 1 will be described next. As described above, the first coil pattern 11 and the second coil pattern 12 are formed by growing the first spiral conductor 41 and the second spiral conductor 51 by plating in the plating bath 61. In such a case, there are cases in which foreign matters such as plating residues are mixed inside the plating solution 60 in the plating bath 61. In the above case, in the course of forming the first coil pattern 11 and the second coil pattern 12, as illustrated in FIG. 9, there is a possibility of plating residues 66 adhering between the conductors of the first coil pattern 11 and the second coil pattern 12. Furthermore, if the plating residues 66 that have adhered between the first coil pattern 11 and the second coil pattern 12 are left unattended, depending on the size of the plating residues 66, a concern of a short circuit in the first coil pattern 11 and in the second coil pattern 12 arises. Furthermore, since the sizes of the plating residues 66 are minute of about a few micrometers, for example, it is not easy to remove the plating residues 66 from the plating bath 61. Accordingly, in order to suppress short circuit failures from occurring in the first coil pattern 11 and in the second coil pattern 12 even in a case in which there are plating residues 66 in the plating solution 60, the coil component 1 adopts a structure in which the first recessed groove 20 and the second recessed groove 30 are provided in the insulating substrate 10.

Detailed description will be given now with reference to FIG. 9. The plating residues 66 that are attached with a reference sign A are adhered so as to extend across the conductors of the first coil pattern 11 and the second coil pattern 12 while in contact with both of the neighboring conductors. Meanwhile, the plating residues 66 that are attached with a reference sign B are adhered to only one of the neighboring conductors (not in contact with the other conductor) in the first coil pattern 11 and the second coil pattern 12. Now, there is a high possibility that the short circuit failure owing to the plating residues 66A is found during the delivery inspection and the like carried out by the supplier (the component manufacturer) when shipping the coil component. However, if a coil component having the plating residues 66B adhered thereto were to be manufactured and shipped, there is a possibility of a short circuit failure occurring in the coil when the vendor that has bought the coil component is in the course of installing the coil component in an electronic device. For example, when the coil component is mounted on a substrate of an electronic device by soldering, due to contraction of the coil component caused by heat stress during reflow, a short circuit is anticipated to be caused between the coil conductors with the plating residues 66B. Since the latter short circuit failure occurs after being shipped from the supplier, disadvantageously, it will be difficult to find the short circuit failure at the time of shipping.

Figure 10:
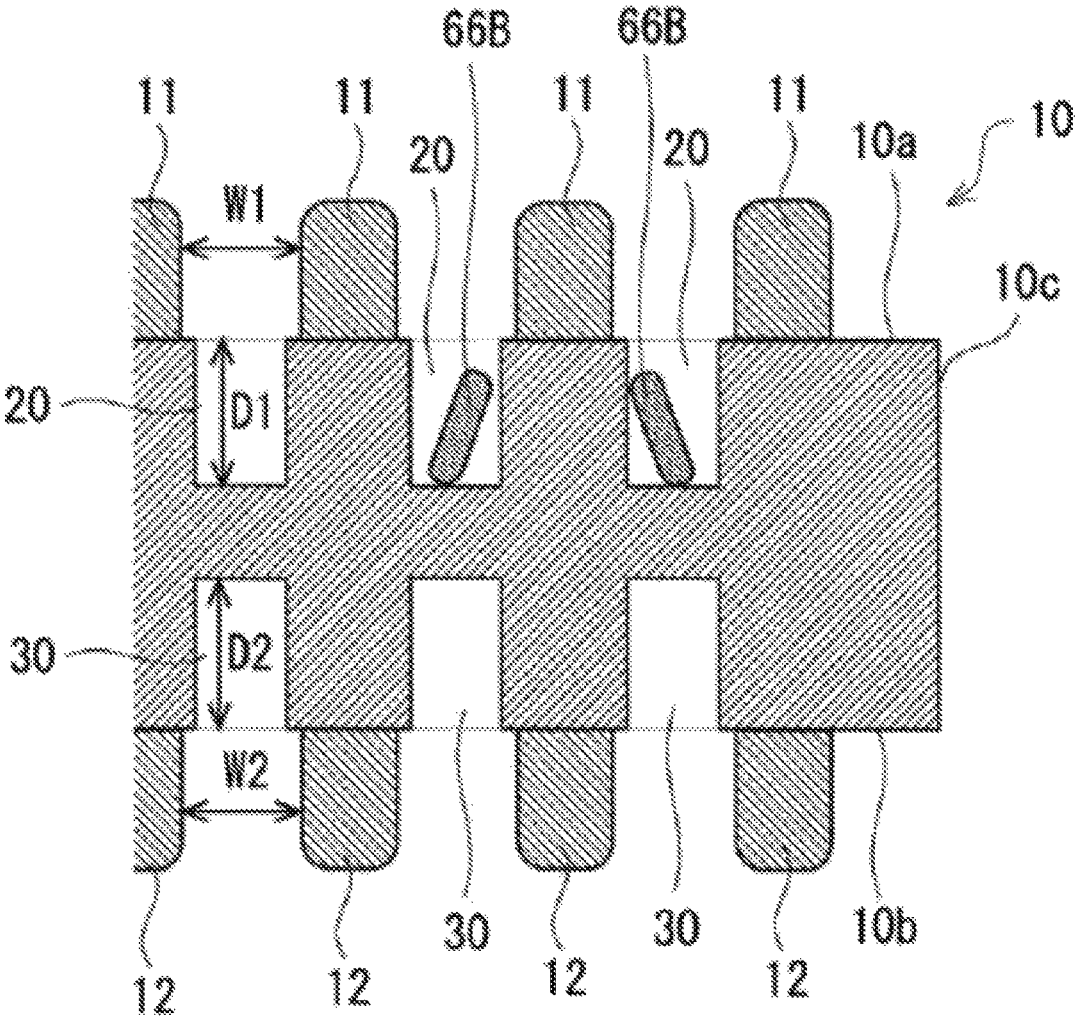
FIG. 10 is a diagram for describing the functions of the first recessed groove and the second recessed groove of the coil component according to the embodiment.

Conversely, in the coil component 1 according to the present embodiment, as illustrated in FIG. 10, the first recessed groove 20 and the second recessed groove 30 functioning as storage portions that store the plating residues 66 are included in the upper surface 10*a* and the undersurface 10*b*, respectively, of the insulating substrate 10. With the above, the plating residues 66 adhered to the first coil pattern 11 and the second coil pattern 12 may be stored inside the first recessed groove 20 and the second recessed groove 30. Accordingly, short circuit caused by plating residues 66 in the portions between the conductors of the first coil pattern 11 and those of the second coil pattern 12 may be suppressed.

In the insulating substrate 10 of the present embodiment, the first recessed groove depth D1 of the first recessed groove 20 is configured so that the dimension thereof is equivalent to or greater than that of the first coil conductor interval W1 of the first coil pattern 11. The reason for the first recessed groove depth D1 of the first recessed groove 20 being configured so that the dimension thereof is equivalent to or greater than that of the first coil conductor interval W1 is to store the plating residues 66, which have sizes that are the same as the size of the first coil conductor interval W1 at the most, inside the first recessed groove 20 without having the plating residues 66 protrude outside the first recessed groove 20. The above considers the fact that even if there were to be short circuiting between the neighboring conductors of the first coil pattern 11 caused by the plating residues 66 having sizes that are greater than the first coil conductor interval W1, the short circuit failure will be found during delivery inspection of the coil component 1. The present embodiment enables the plating residues 66 having sizes that are equivalent to or smaller than the first coil conductor interval W1 to be stored inside the first recessed groove 20 without being protruded outside the first recessed groove 20. With the above, short circuit failure in the first coil pattern 11 that is caused by the plating residues 66 having sizes that are equivalent to or smaller than the first coil conductor interval W1 and that is difficult to be found during the delivery inspection may be suitably suppressed.

In a similar manner, in the second recessed groove 30 of the present embodiment, the dimension of the second recessed groove depth D2 is configured so as to be equivalent to or greater than that of the second coil conductor interval W2. Accordingly, it is possible to store the plating residues 66 having sizes that are, at the most, equivalent to the second coil conductor interval W2 without the plating residues 66 protruding out from the second recessed groove 30. With the above, short circuit failure in the second coil pattern 12 that is caused by the plating residues 66 having sizes that are equivalent to or smaller than the second coil conductor interval W2 and that is difficult to be found during the delivery inspection may be suitably suppressed.

Note that during the manufacturing process of the coil component 1, when sealing the insulating substrate 10 with the resin containing a magnetic substance, the resin containing a magnetic substance is filled into the first recessed groove 20 and the second recessed groove 30. Accordingly, the plating residues 66 that have fallen into the first recessed groove 20 and the second recessed groove 30 are sealed by the insulating resin 16 while being stored inside the recessed grooves 20 and 30. With the above, short circuit failures of the first coil pattern 11 and the second coil pattern 12 may be further suppressed in a suitable manner. Note that in the present embodiment, the first recessed groove 20 and the second recessed groove 30 may be formed in the insulating substrate 10 before the first coil pattern 11 and the second coil pattern 12 are formed on the insulating substrate 10 by plating.

Furthermore, in the present embodiment, as illustrated in FIG. 5, the width dimension of the first recessed groove 20 in the insulating substrate 10 is substantially the same as the first coil conductor interval W1 of the first coil pattern 11, and the width dimension of the second recessed groove 30 is substantially the same as the second coil conductor interval W2 of the second coil pattern 12. According to the above, sufficient capacity for storing the plating residues 66 may be obtained and regardless of the shapes of the plating residues 66, the plating residues 66 may be stored in the first recessed groove 20 and the second recessed groove 30. In other words, securing the width dimension of each of the first recessed groove 20 and the second recessed groove 30 is advantageous in that the plating residues 66 having wide-width shapes as well are capable of being stored in the first recessed groove 20 and the second recessed groove 30.

Furthermore, the first recessed groove 20 and the second recessed groove 30 of the present embodiment are arranged at the center between the conductors of the first coil pattern 11 and the second coil pattern 12, respectively. In other words, the middle portion between the conductors of the first coil pattern 11 and the middle portion of the first recessed groove 20 in the width direction coincide each other and the middle portion between the conductors of the second coil pattern 12 and the middle portion of the second recessed groove 30 in the width direction coincide each other. According to the above, the distance between each of the neighboring pairs of conductors in the first coil pattern 11 and the plating residues 66 that are stored in the corresponding first recessed groove 20 positioned between the pair of conductors become uniform. Similarly, the distance between each of the neighboring pairs of conductors in the second coil pattern 12 and the plating residues 66 that are stored in the corresponding second recessed groove 30 positioned between the pair of conductors become uniform. With the above, occurrences of the short circuit failures of the first coil pattern 11 and the second coil pattern 12 may be further suppressed in a suitable manner.

Various modifications and improvements may be made to the above-described embodiment. Hereinafter, a modification of the coil component 1 of the present embodiment will be described. In the first embodiment, the coil patterns are formed on both surfaces of the insulating substrate 10; however, the coil patterns may be formed on only one surface. In such a case, the recessed groove between the conductors of the coil pattern that stores the plating residues 66 may be formed in the surface on which the coil pattern is formed. Furthermore, in plan view, the first recessed groove 20 (the second recessed groove 30) illustrated in FIG. 3 (FIG. 4) and the like has a spiral shape similar to that of the first coil pattern 11 (the second coil pattern 12); however, the shape is not limited to the above shape. For example, a plurality of first recessed grooves 20 (second recessed grooves 30) may be arranged in series (intermittently) in the direction in which the spiral of the first coil pattern 11 (the second coil pattern 12) extends.

Figure 11:
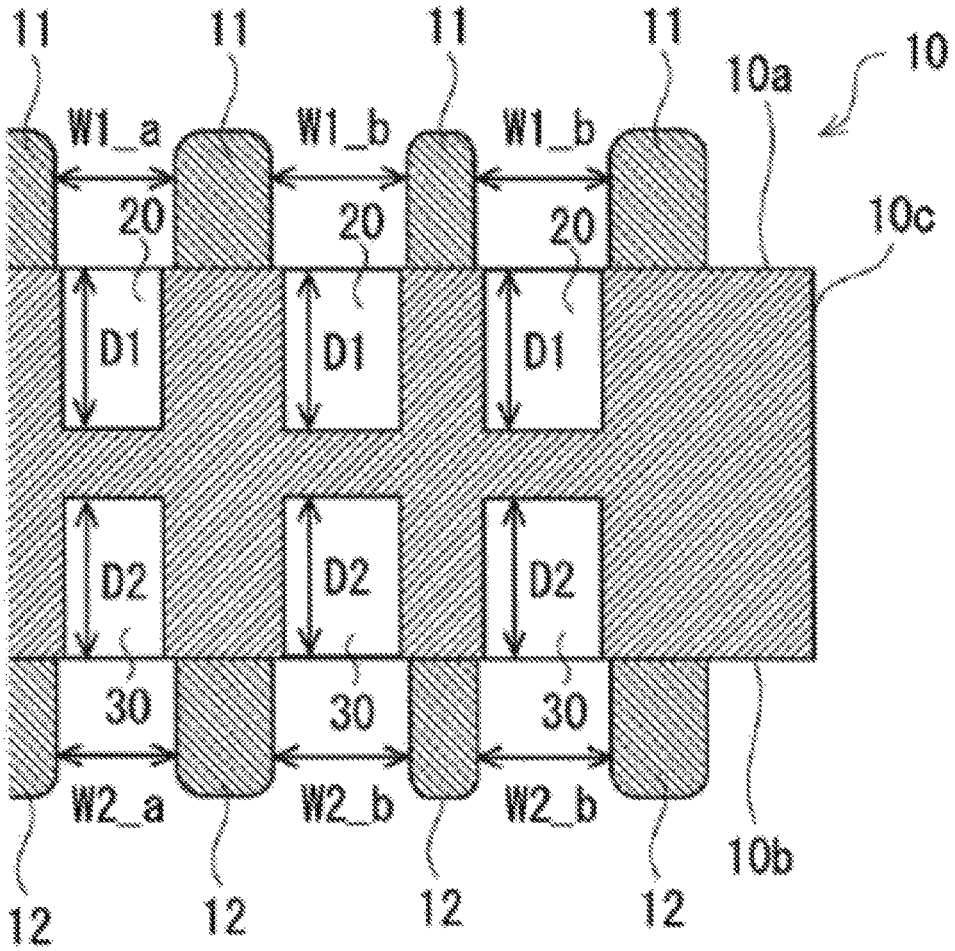
FIG. 11 is a diagram for describing a coil component according to a first modification.

Furthermore, as a first modification illustrated in FIG. 11, the first coil conductor interval W1 (the second coil conductor interval W2) of the first coil pattern 11 (the second coil pattern 12) on the insulating substrate 10 may vary at different positions (W1#*a*≠W1#*b*, W2#*a*≠W2#*b*). In such a case, the maximum dimension of the first coil conductor interval W1 (the second coil conductor interval W2) in the first coil pattern 11 (the second coil pattern 12) may be set as a reference, and the first recessed groove depth D1 (the second recessed groove depth D2) may be configured to have a dimension that is equivalent to or greater than the reference. In the example in FIG. 11, the size relation is W1#*a*<W1#*b* (W2#*a*<W2#*b*); accordingly, the W1#*b* (W2#*b*) that is the largest dimension of the first coil conductor interval W1 (the second coil conductor interval W2) of the first coil pattern 11 (the second coil pattern 12) is set as the reference. Furthermore, the dimension of the first recessed groove depth D1 (the second recessed groove depth D2) may be set so as to be equivalent to or greater than the W1#*b* (W2#*b*). Note that the depths of the first recessed groove depth D1 and the second recessed groove depth D2 may be varied at different positions as long as the first recessed groove depth D1 and the second recessed groove depth D2 are equivalent to or greater than the corresponding portions of the first coil conductor interval W1 and the second coil conductor interval W2.

Figure 12:
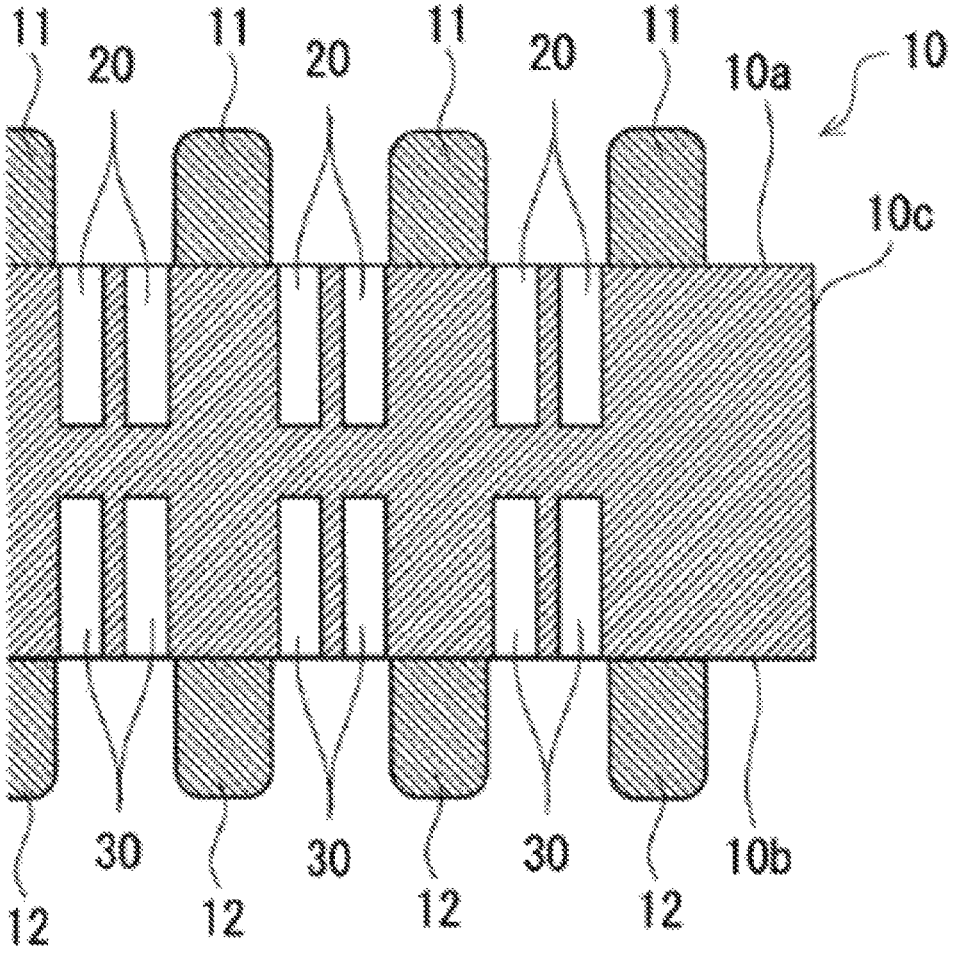
FIG. 12 is a diagram for describing a coil component according to a second modification.
Figure 13:
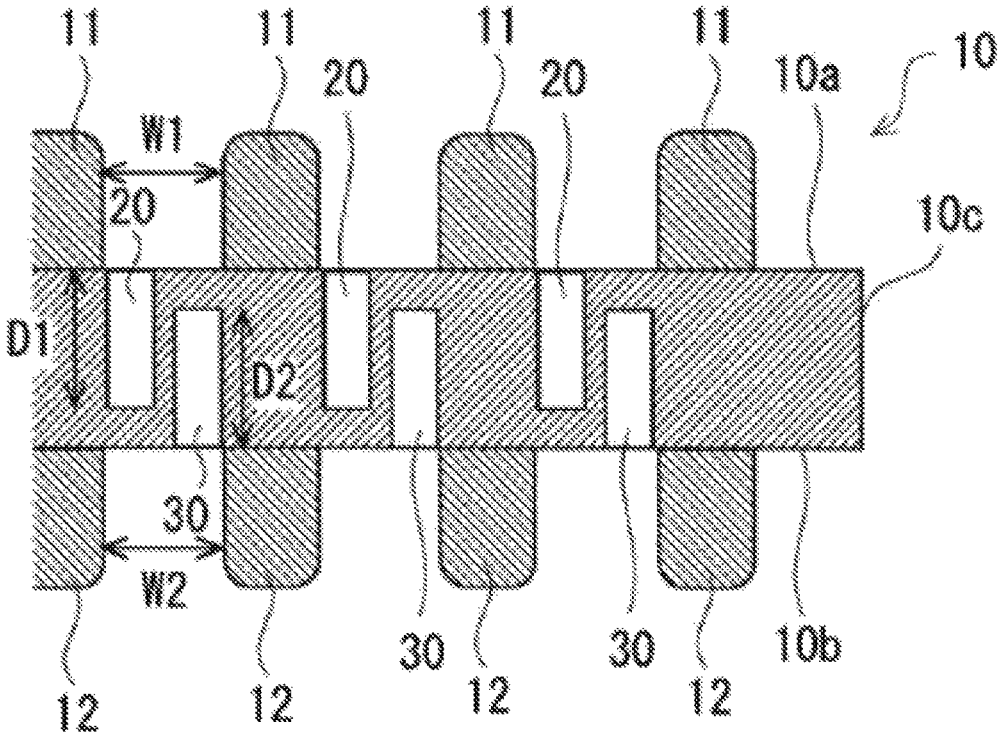
FIG. 13 is a diagram for describing a coil component according to a third modification.

Furthermore, as a second modification illustrated in FIG. 12, a plurality of first recessed grooves 20 (second recessed grooves 30) may be formed between the neighboring conductors of the first coil pattern 11 (the second coil pattern 12) on the insulating substrate 10. Furthermore, in the embodiment and the modification described above, the first recessed groove 20 formed on the upper surface 10*a* side of the insulating substrate 10 and the second recessed groove 30 formed on the undersurface 10*b* side of the insulating substrate 10 are formed so as to overlap each other in plan view; however, as a third modification illustrated in FIG. 13, the disposed positions may be offset with respect to each other. In the example illustrated in FIG. 13, in order for the first recessed groove 20 and the second recessed groove 30 to not overlap one another in the up-down direction, each of the first recessed groove 20 and the second recessed groove 30 is arranged in an eccentric manner with respect to the corresponding coil conductor. According to the above, it is possible to make the thickness of the insulating substrate 10 thin (to reduce the thickness of the insulating substrate 10) while securing the first recessed groove depth D1 (the second recessed groove depth D2) of the first recessed groove 20 (the second recessed groove 30) that is equivalent to or greater than the first coil conductor interval W1 (the second coil conductor interval W2).

Figure 14:
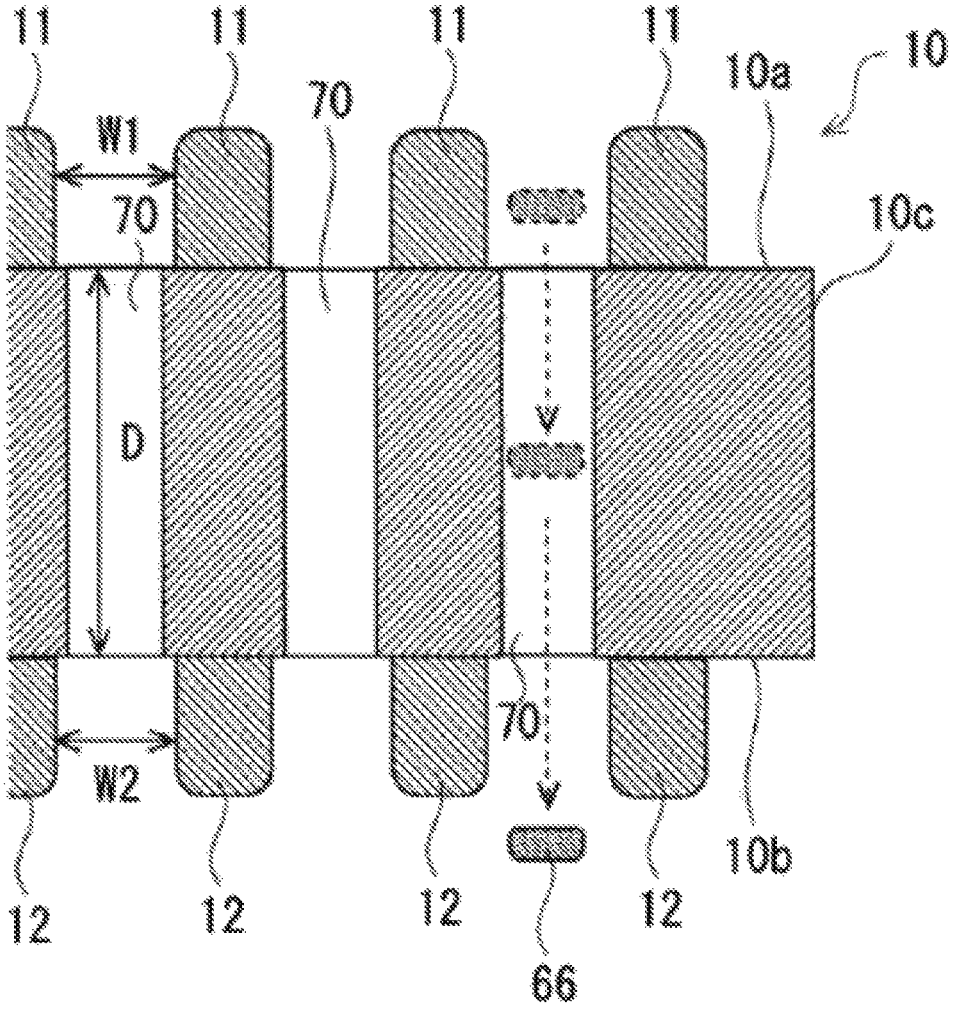
FIG. 14 is a diagram for describing a coil component according to a fourth modification.
Figure 15:
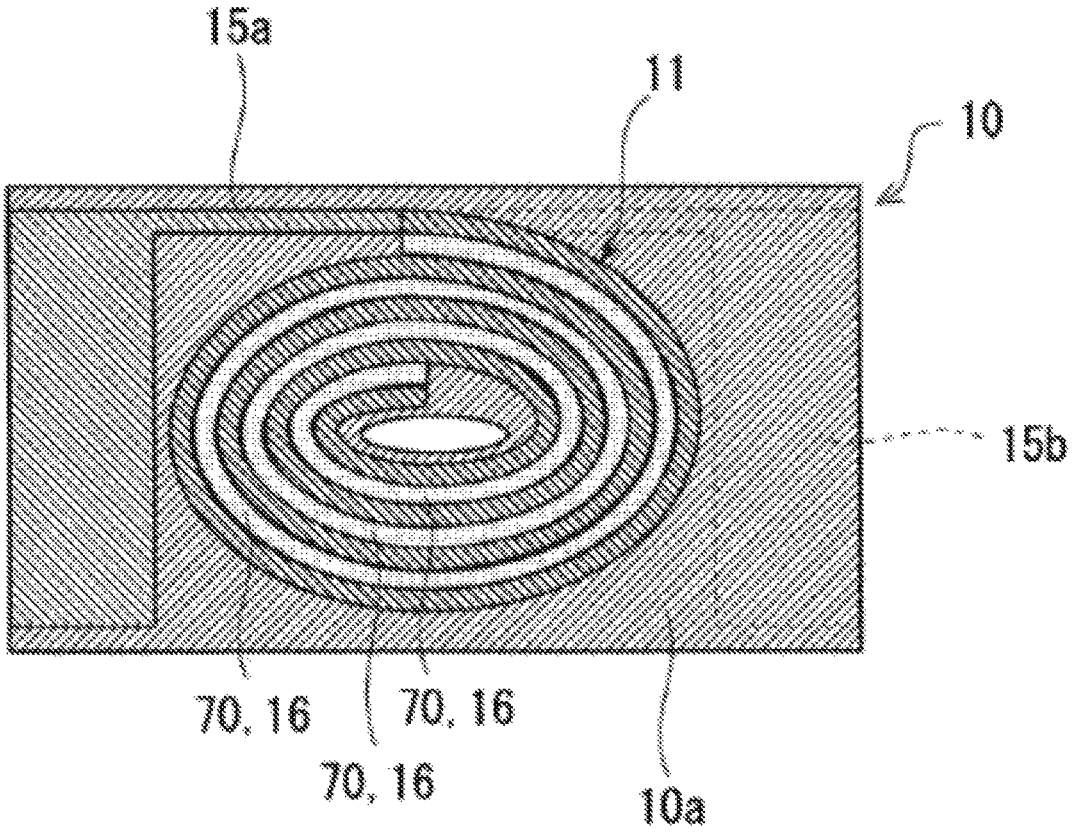
FIG. 15 is a top view of the insulating substrate according to the fourth modification.
Figure 16:
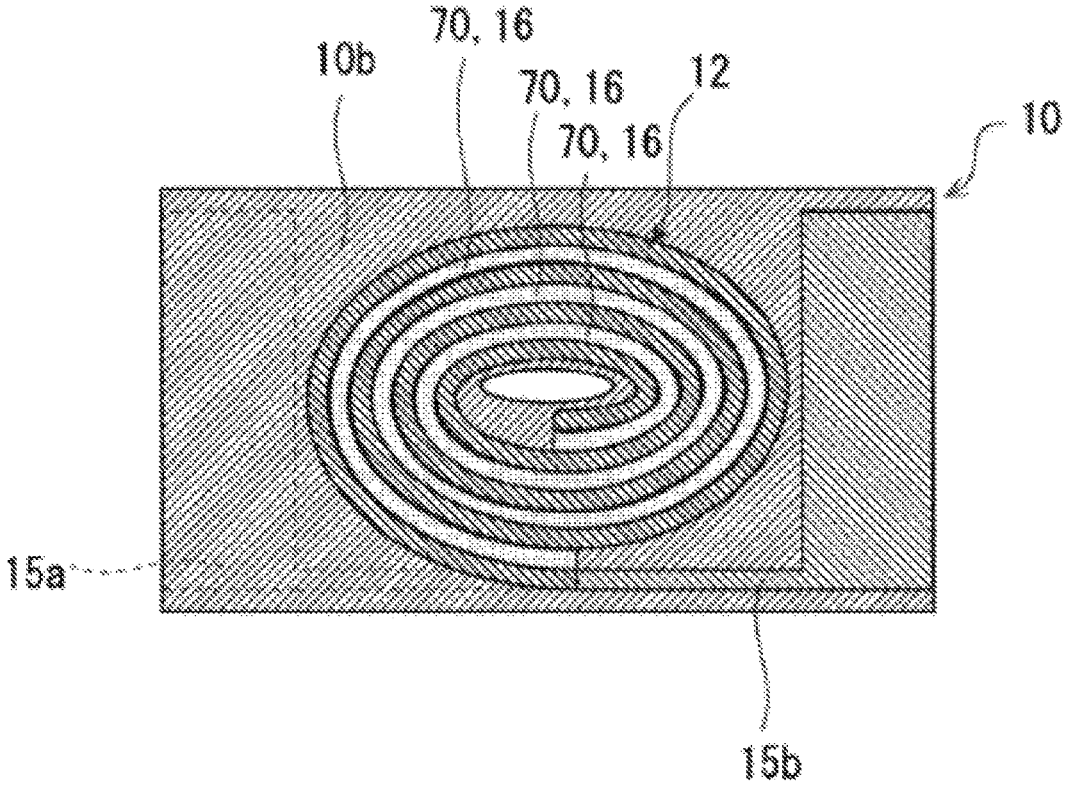
FIG. 16 is a bottom view of the insulating substrate according to the fourth modification.

Furthermore, in the embodiment and the modifications described above, the first recessed groove 20 (the second recessed groove 30) is formed as a non-through hole between the neighboring conductors of the first coil pattern 11 (the second coil pattern 12) on the insulating substrate 10; however, a through hole that penetrates through the insulating substrate 10 may be formed. In a fourth modification illustrated in FIG. 14, a through hole 70 that penetrates the insulating substrate 10 in the thickness direction at a portion between the neighboring conductors of the first coil pattern 11 (the second coil pattern 12) in the insulating substrate 10 is formed. Similar to the first recessed groove 20 and the second recessed groove 30, the through hole 70 is formed by laser. The through hole 70 is an example of an opening portion that is open in the surface of the substrate and that is formed as a groove or a hole. Note that the configurations of the first coil pattern 11 and the second coil pattern 12 of the present modification are similar to those described in FIGS. 3 and 4 and have a spiral shape that overlaps one another in plan view. Furthermore, as illustrated in FIGS. 15 and 16, the through hole 70 has the same spiral shape as the first coil pattern 11 and the second coil pattern 12 and is formed so as to be positioned between the neighboring conductors of the first coil pattern 11 and the second coil pattern 12. FIG. 15 is a top view of the insulating substrate according to a fourth modification and is a diagram that corresponds to FIG. 3. FIG. 16 is a bottom view of the insulating substrate according to the fourth modification and is a diagram that corresponds to FIG. 4.

Providing the through hole 70 in the insulating substrate 10 in place of the groove shaped opening portions such as the first recessed groove 20 and the second recessed groove 30 that are illustrated in FIG. 5 has an advantage in that the plating residues 66 may be dropped off and removed from the insulating substrate 10 through the through hole 70. For example, as illustrated in FIG. 14, a plating residue 66 that is positioned between the conductors of the first coil pattern 11 positioned on the upper surface 10*a* side of the insulating substrate 10 passes through the through hole 70 and falls below the insulating substrate 10. According to the present modification, after the plating process, the plating residues 66 is trimmed so as to enable the plating residues 66 adhered to the conductors of the first coil pattern 11 and the second coil pattern 12 to be removed. Note that in forming the through hole 70 by performing laser beam machining on the insulating substrate 10, the plating residues 66 that are positioned between the conductors of the first coil pattern 11 and between the conductors of the second coil pattern 12 are melted by the heat of the laser and are removed.

Figure 17:
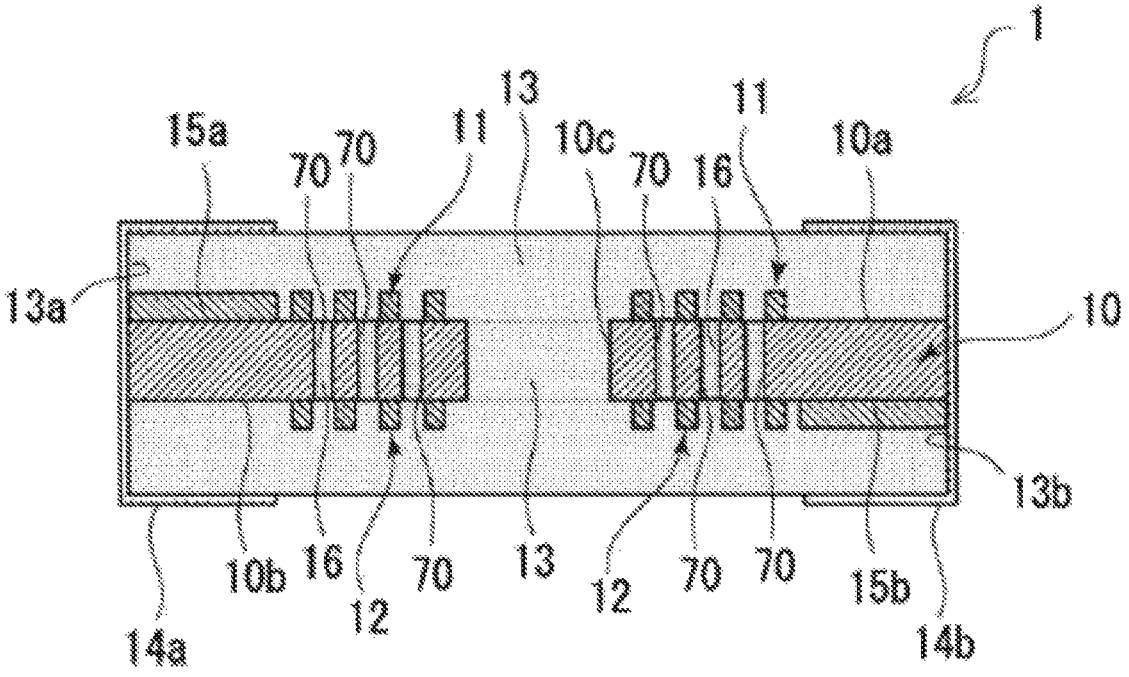
FIG. 17 is a cross-sectional view of the coil component according to the fourth modification.

Note that as in the present modification, when the through hole 70 is provided in the insulating substrate 10, a depth D of the through hole 70 does not necessarily have to be secured so as to be equivalent to or greater than the first coil conductor interval W1 and the second coil conductor interval W2. The above is because, regardless of the depth of the through hole 70, the plating residues 66 adhered to the conductors of the first coil pattern 11 and the second coil pattern 12 may be dropped off and removed through the through hole 70. Now, since the depth of the through hole 70 is the same as the thickness of the insulating substrate 10, in the present modification, the thickness dimension of the insulating substrate 10 may be made thin (small). Note that in FIG. 17 is a cross-sectional view of the coil component 1 according to the fourth modification and is a diagram corresponding to FIG. 2. In the present modification as well, after trimming the plating residues 66, the resin 16 is filled into the through hole 70 and, further, the insulating substrate 10 is covered by the exterior core 13 including the resin containing a magnetic substance.

The coil component and the method for manufacturing the coil component has been described above in accordance with the embodiment and the modifications, and it is obvious to those skilled in the art that various modifications, improvements, and combinations of the embodiment and modifications described above may be performed. Note that the coil component according to the embodiment and modifications described above is applied to mobile devices, such as mobile phones, smartphones, tablet PCs; however, not limited to the above, the coil component may be applied to various electronic components.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. A method of manufacturing a coil component, comprising;

preparing a substrate;

forming an opening in a center portion of the substrate;

forming a first coil pattern over an upper surface of the substrate so as to surround the opening and have a spiral shape;

forming a first recessed groove in the upper surface of the substrate and between the first coil pattern;

forming a second coil pattern over a bottom surface of the substrate so as to surround the opening and have a spiral shape;

forming a second recessed groove in the bottom surface of the substrate and between the second coil pattern; and forming a conductor that penetrates the substrate and coupled to the first coil pattern and the second coil pattern.

2. The method according to claim 1, wherein the opening is formed so as to have a shape that is analogous to the first coil pattern and extend in an extending direction of the first coil pattern.

3. The method according to claim 1, further comprising: filling the opening portion with resin.

4. The method according to claim 1, wherein the opening is formed as a through hole that penetrates the bottom surface of the substrate.

5. The method according to claim 1, wherein the opening is formed in such a manner that a residue adhering to the first coil pattern and the second coil pattern subsequent to the plating is collected in the first recessed groove and the second recessed groove.

6. The method according to claim 1, wherein the opening is formed in such a manner that the depth is larger than or equal to a distance between the neighboring conductors.

7. The method according to claim 1, wherein the opening is formed in such a manner that the opening is located at a center of a space created by a distance between the neighboring conductors.

8. The method according to claim 1, wherein the first recessed groove and the second recessed groove are formed in such a manner that each of the first recessed groove and the second recessed groove has a plurality of recessed grooves including the respective first recessed groove and second recessed groove in the substrate.

9. The method according to claim 1, wherein the first recessed groove and the second recessed groove are formed in such a manner that the first recessed groove is offset from the second recessed groove in a plan view.

* * * * *